US009167923B1

(12) United States Patent
Holbrook

(10) Patent No.: US 9,167,923 B1
(45) Date of Patent: Oct. 27, 2015

(54) PILLOW HAVING CROSS-FLOW MESH INSERTS

(71) Applicant: Standard Fiber, LLC, Burlingame, CA (US)

(72) Inventor: Russ Holbrook, Matthews, NC (US)

(73) Assignee: Standard Fiber, LLC, Burlingame, CA (US)

( * ) Notice: Subject to any disclaimer, the term of this patent is extended or adjusted under 35 U.S.C. 154(b) by 0 days.

(21) Appl. No.: 14/644,931

(22) Filed: Mar. 11, 2015

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01)

(58) Field of Classification Search
CPC ..... A47G 9/10
USPC ..... 5/636, 638, 641, 724, 652.1, 490
See application file for complete search history.

(56) References Cited

U.S. PATENT DOCUMENTS

| | | | | |
|---|---|---|---|---|
| 1,876,591 | A * | 9/1932 | Bawden | 5/490 |
| 3,616,470 | A * | 11/1971 | Young | 5/638 |
| 4,445,241 | A * | 5/1984 | Ender et al. | 5/652.1 |
| 4,665,575 | A * | 5/1987 | Raught | 5/722 |
| 5,163,194 | A | 11/1992 | Dixon | |
| 5,388,296 | A * | 2/1995 | Mansour | 5/636 |
| 5,608,936 | A * | 3/1997 | Nomura | 5/645 |
| D448,229 | S | 9/2001 | Su | |
| 6,408,468 | B1 | 6/2002 | Comfort | |
| 6,760,935 | B1 | 7/2004 | Burton et al. | |
| 7,107,638 | B2 | 9/2006 | Wilson | |
| 7,143,457 | B2 | 12/2006 | MacDonald | |
| 7,588,291 | B2 | 9/2009 | Gold et al. | |
| D604,550 | S | 11/2009 | Carter | |
| 8,393,025 | B2 | 3/2013 | Crispino et al. | |
| 8,646,134 | B1 * | 2/2014 | Alletto, Jr. | 5/636 |
| 8,745,793 | B2 | 6/2014 | Bensoussan | |
| 8,887,332 | B2 | 11/2014 | Alletto | |
| 2005/0193490 | A1 | 9/2005 | MacDonald | |
| 2006/0130235 | A1 | 6/2006 | Wilson | |
| 2008/0244832 | A1 * | 10/2008 | Kuo | 5/638 |
| 2009/0001801 | A1 | 1/2009 | Gold et al. | |
| 2010/0154122 | A1 | 6/2010 | Crispino et al. | |
| 2010/0235992 | A1 | 9/2010 | Bensoussan | |
| 2014/0096323 | A1 | 4/2014 | Alletto | |
| 2014/0196216 | A1 | 7/2014 | Weitzel et al. | |

OTHER PUBLICATIONS

U.S. Appl. No. 14/560,419.

* cited by examiner

*Primary Examiner* — Michael Trettel
(74) *Attorney, Agent, or Firm* — Levenfeld Pearlstein, LLC

(57) ABSTRACT

A pillow and a pillow cover are provided. The pillow and pillow cover include a cover layer defining an interior volume, the cover layer having a first side facing outward substantially in a first direction, a second side facing outward substantially in a second direction, opposite to the first direction, and a perimeter formed at a boundary of the first side and the second side. The cover layer includes a body portion, a first mesh portion and a second mesh portion formed separately and spaced apart from the first mesh portion. The pillow includes a filler material disposed in the interior volume. The interior volume is in fluid communication with the external atmosphere via the first and second mesh portions.

13 Claims, 4 Drawing Sheets

PILLOW HAVING CROSS-FLOW MESH INSERTS

BACKGROUND

The following description relates to a pillow, and in particular, a pillow having mesh inserts to allow for a cross-flow of air through the pillow.

A pillow typically includes an outer layer or cover, such as a pillow shell, generally made of a fabric material. The outer layer defines an internal space configured to house a padding or filler material. The outer layer may include one or more pieces of fabric stitched around the inner padding or filler material. Further, or alternatively, the outer layer may include a zipper, slide fastener or other similar fastener along at least a portion of one or more sides to selectively provide or restrict access to the internal space. In some pillows, a gusset may be provided that extends around a perimeter of the pillow generally between an upper half and a lower half of the pillow. The gusset may be used to increase a volume of the internal space by increasing a thickness of the pillow.

The fabric of the outer layer may be generally homogenous such that similar properties are found across the outer layer. For example, the fabric may have generally the same stiffness, softness and/or density across the outer layer. Accordingly, a breathability of the fabric, i.e., an ability to allow air to flow between the internal space and external atmosphere may be generally constant across the outer layer.

In use, a person may lean, lie, sit or otherwise support a portion of their body on or against the pillow. Heat from the person may be transferred to the pillow via contact between the person and the outer layer. With limited or restricted breathability through the outer layer, i.e., with limited airflow through the outer layer, the heat may be retained by the pillow, both in the outer layer and the inner padding or filler. As result, a temperature of the pillow may increase to a point where it may not be comfortable for the person using the pillow, particularly at a location where the person is in contact with the pillow.

Accordingly, it is desirable to provide a pillow that allows for increased breathability, i.e., airflow through the outer layer, to limit or prevent an undesirable increase in temperature of the pillow.

SUMMARY

According to one aspect, there is provided a pillow having a cover layer defining an interior volume. The cover layer has a first side facing outward substantially in a first direction, a second side facing outward substantially in a second direction, opposite to the first direction, and a perimeter formed at a boundary of the first side and the second side. The cover layer includes a body portion, a first mesh portion and a second mesh portion formed separately and spaced apart from the first mesh portion. A filler material is disposed in the interior volume, and the interior volume is in fluid communication with the external atmosphere via the first and second mesh portions.

According to another aspect, there is provided a pillow cover having a cover layer defining an interior volume. The cover layer has a first side facing outward substantially in a first direction, a second side facing outward substantially in a second direction, opposite to the first direction, and a perimeter formed at a boundary of the first side and the second side. The cover layer includes a body portion, a first mesh portion and a second mesh portion formed separately and spaced apart from the first mesh portion. The interior volume is in fluid communication with the external atmosphere via the first and second mesh portions.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
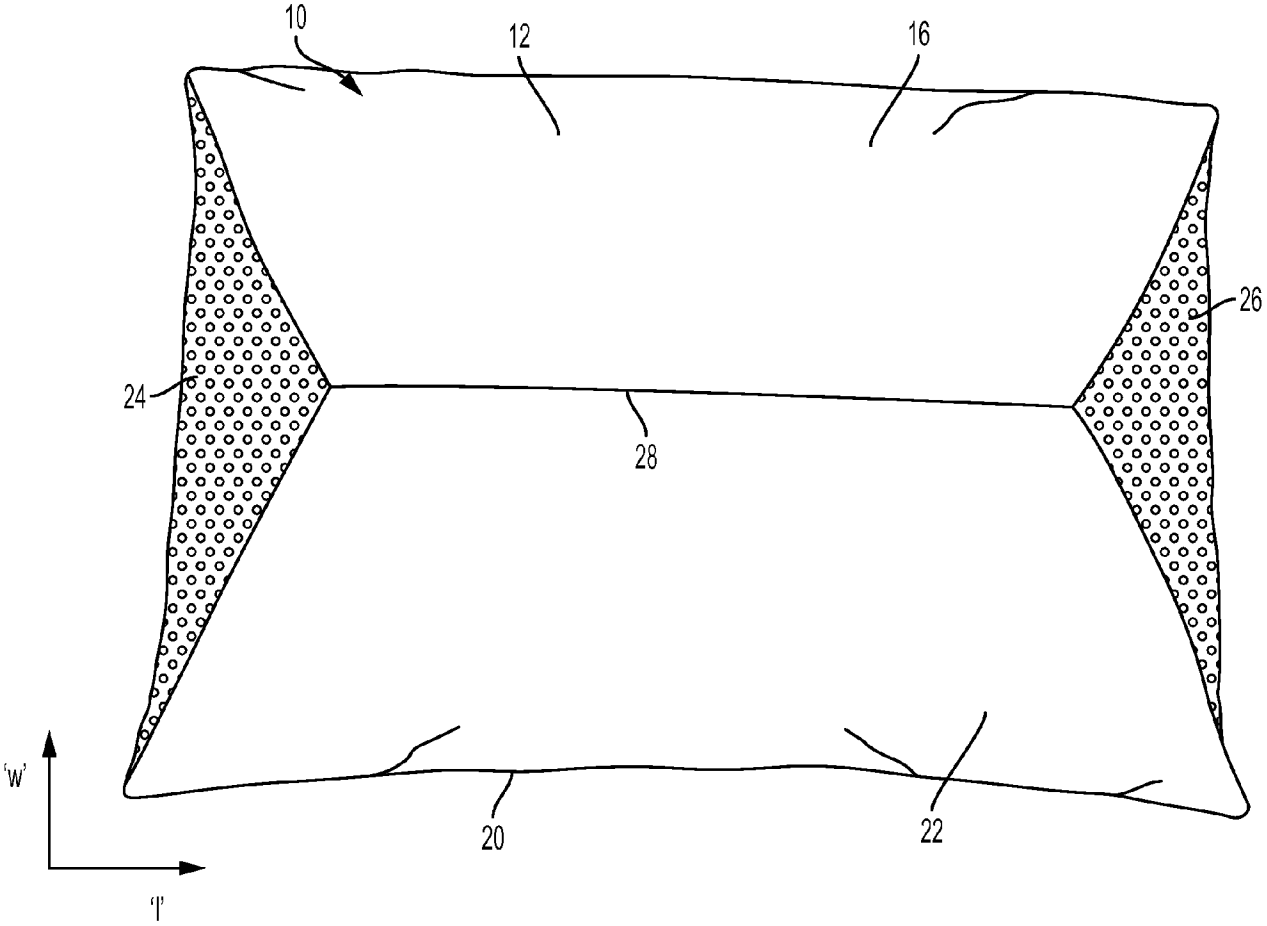
FIG. 1 is a top view of an example of a first side of a pillow according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
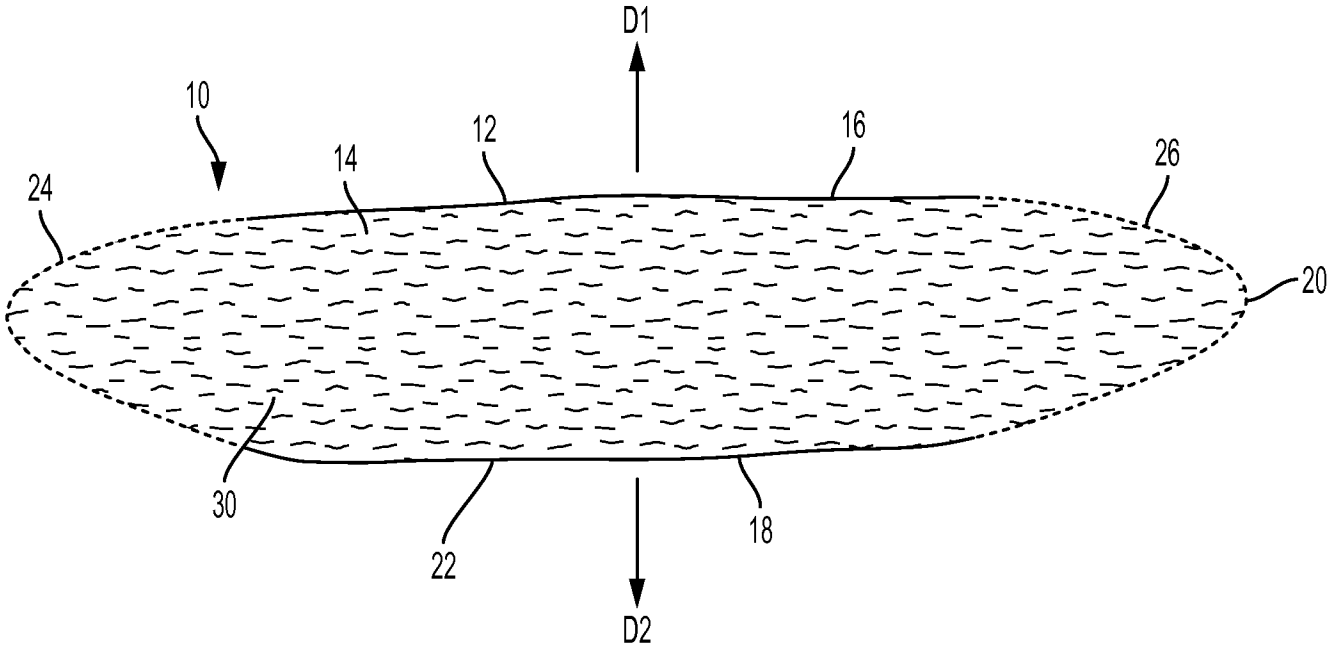
FIG. 2 is a cross-sectional view of the pillow of FIG. 1 according to an embodiment described herein.

FIG. 1 is top view of a pillow 10 according to an embodiment described herein, and FIG. 2 is a cross-sectional view of the pillow 10 of FIG. 1. Referring to FIGS. 1 and 2, the pillow 10 includes a cover layer 12 defining an interior volume 14. The cover layer 12 includes a first side 16 facing outward substantially in a first direction D1, and a second side 18 opposite to the first side 16, facing outward substantially in a second direction D2. The first direction D1 and the second direction D2 extend in substantially opposite directions. In one embodiment, the first side 16 may be a top side of the pillow 10 defining a top surface facing generally upward and the second side 18 may be a lower side of the pillow defining a lower surface facing generally downward.

The cover layer also includes a perimeter 20 or peripheral edge formed at a boundary of the first side 16 and the second side 18. That is, the perimeter 20 may separate a portion of the cover layer 12 that faces generally in the first direction D1, i.e., the first side 16, from a portion of the cover layer 12 that faces generally in the second direction D2, i.e., the second side 18. The perimeter 20 generally corresponds to an outer periphery of the pillow 10 in a plan view, such as the top view shown in FIG. 1, and generally defines a shape of the pillow 10. In one embodiment, the pillow 10 is formed without a gusset between the first side 16 and the second side 18. However, it is understood that the present description is not limited to this configuration, and that in an alternative embodiment, the perimeter 20 may include a gusset between the first side 16 and the second side 18.

The cover layer 12 also includes a body portion 22, a first mesh portion 24 and a second mesh portion 26. The body portion 22, first mesh portion 24 and second mesh portion 26 may be formed on one or more of the first side 16, the second side 18 and the perimeter 20 of the cover layer 12. The body portion 22 may be constructed of one or more panels of material. In one embodiment, a single panel of material may extend substantially about the interior volume 14 and may have opposing ends secured together, directly or indirectly, at a seam or similar joint 28. In another embodiment, the body portion 22 may be constructed of multiple panels. For example, the body portion 22 may be constructed of two panels that are secured to one another. In one embodiment, opposite edges of one panel may be secured to corresponding opposite edges of the other panel, directly or indirectly, at corresponding seams or similar joints 28.

In one embodiment, the seam or seams 28 may be formed on one of or both the first side 16 and the second side 18. Alternatively, or in addition, the seam or seams 28 may be formed at the perimeter 20. It is understood that the body portion 22 may include additional panels and is not limited to the examples above. The one or more panels may be secured to one another at the one or more seams or joints 28, for example, by stitching, adhesive, buttons, snaps, a slide fastener, a hook and loop fastener and the like.

The one or more panels of the body portion 22 may be formed as a single ply or multiple plies of material overlaying one another. In one embodiment, two plies of material may quilted, i.e., stitched together, to form a plurality of boxes that may be filled with batting. In other embodiments, the body portion 22 may be formed having only a single ply that is not quilted, or a combination of single ply, multiple ply, quilted and/or non-quilted sections.

With further reference to FIG. 2, a padding or filler material 30 may be disposed within the interior volume 14. The filler material 30 may be, for example a fibrous or foam material. In one embodiment, the filler material 30 may be a polyester fiber. However, the present description is not limited thereto. For example, the padding or filler material 30 may include a foam or gel material. The filler material 30 may optionally be disposed in a filler cover layer (not shown) disposed in the interior volume 14.

Figure 3:
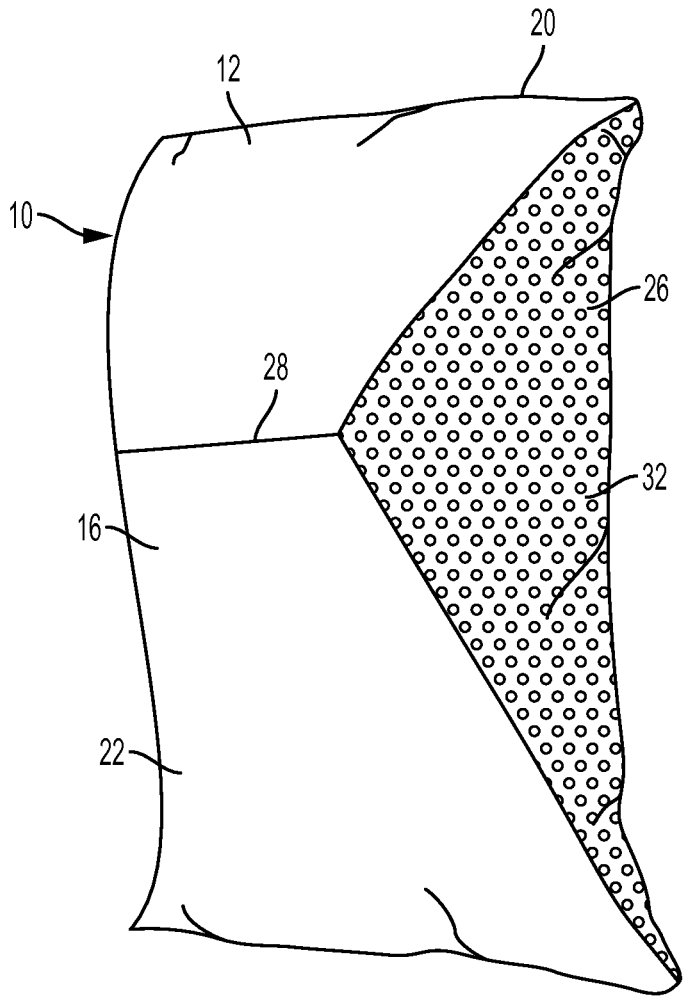
FIG. 3 is a top view of a portion of the first side of the pillow of FIG. 1.

FIG. 3 is an enlarged top view showing a portion of the pillow 10 of FIG. 1. Referring to FIGS. 1-3, each of the first and second mesh portions 24, 26 includes a plurality of openings 32 to allow for fluid communication, e.g., airflow, between the interior volume 14 and the external atmosphere. That is, the first and second mesh portions 24, 26, allow for air to flow between interior volume 14 and the external atmosphere via the openings 32. In one embodiment, the openings 32 are of a predetermined size and shape and are positioned at predetermined positions along the mesh portions 24, 26. In one embodiment, the openings 32 are positioned at regularly spaced intervals along the mesh portions 24, 26. That is, equal spacing may exist between each opening 32 and the nearest adjacent opening or openings 32. The openings 32 may all be similarly shaped and sized. Alternatively, the mesh portions 24, 26 may be manufactured with openings 32 having predetermined sizes and shapes that vary among one another.

Accordingly, the mesh portions 24, 26, via the openings 32, are configured to allow an increased flow of air into and out of the interior volume 14, per unit area, than the body portion 22. The cover layer 12, including the body portion 22, the first mesh portion 24 and the second mesh portion 26 may be made from, for example, a fabric material, such as a knitted fabric, a sateen weave, or any flat weave fabric. In some embodiments, the mesh portions 24, 26 may also, or alternatively, be made from nylon, polyester or another similar material.

The mesh portions 24, 26 may be secured to the body portion 22, for example, by stitching, adhesive or other similar known fastening technique. As shown in FIGS. 1 and 2, the first and second mesh portions 24, 26 may be positioned at opposite ends of the pillow 10 spaced apart by the body portion 22. The mesh portions 24, 26 may extend along a width direction 'w' of the pillow 10, and are spaced apart along a length direction 'l' of the pillow 10. In one embodiment, for example, the mesh portions 24, 26 may extend completely across the width direction 'w' of the pillow, and partially across the length direction 'l'. However, it is understood that the present disclosure is not limited to this configuration, and that the mesh portions 24, 26 may also, for example, extend along the length direction 'l' of the pillow 10 and be spaced apart in the width direction 'w' of the pillow 10.

Figure 4:
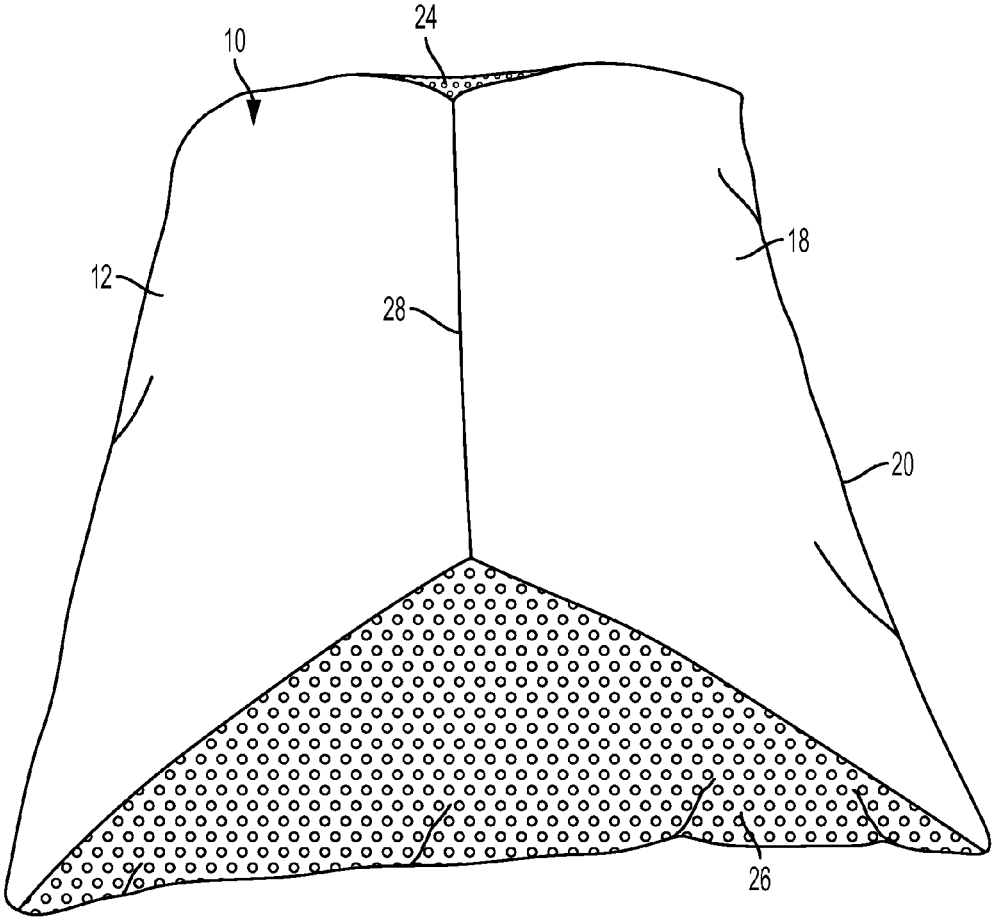
FIG. 4 is a perspective view showing a second side of the pillow of FIG. 1 according to an embodiment described herein.

FIG. 4 is a top perspective view of the second side 18 of the pillow 10 of FIG. 1, according to an embodiment described herein. The first and second mesh portions 24, 26 may extend over respective portions of the first side 16, second side 18 and the perimeter 20. As best shown in FIGS. 1 and 3, the first and second mesh portions 24, 26 may be formed substantially in a triangular shape, when viewed in a top or plan view, on the first side 16. Similarly, with further reference to FIG. 4, the first and second mesh portions 24, 26 may be formed substantially in a triangular shape, in a bottom or plan view, on the second side 18.

In one embodiment, the first side 16 and second side 18 are identically formed, such that the first and second mesh portions 24, 26 have the same shape and dimensions on both the first side 16 and the second side 18. Likewise, the first and second mesh portions 24, 26 may be formed having the same dimensions as one another. The first and second mesh portions 24, 26 may also be formed in a mirrored relationship to one another on each of the first side 16 and the second side 18. However, it is understood that the present description is not limited to these embodiments and that sizes and shapes of the first and second mesh portions 24, 26 may vary on the first and second sides 16, 18 and relative to one another.

With further reference to FIG. 4, the second side 18 may also include one or more seams 28 extending in the body portion 22. As shown in FIGS. 1 and 4, according to one embodiment, the one or more seams 28 may extend between respective apices of the triangular-shaped first and second mesh portions 24, 26.

In the embodiments above, when viewed from the top or bottom, the pillow 10 may be formed substantially in a rectangular shape. That is, the perimeter 20 may define a substantially rectangular shape. However, it is understood that different shapes are envisioned, including, but not limited to, square, circular, oval, arched and the like.

In the embodiments above, the first and second mesh portions 24, 26 may be separately or discretely formed. It is understood that additional mesh portions are envisioned as well. Additional mesh portions may be formed discretely from the first and second mesh portions 24, 26 and one another.

In one embodiment, the first and second mesh portions 24, 26 are spaced apart so that, in use, a user may lie or support a portion of their body on a central section of the pillow 10, for example, at the body portion 22, between the first and second mesh portions 24, 26. Thus the first and second mesh portions 24, 26 may remain open and unobstructed during use. The interior volume 14 may be in fluid communication with the external atmosphere via the first and second mesh portions 24, 26. In one embodiment, the filler material 30, including interior portions thereof, disposed within the interior volume 14 is also in fluid communication with the external atmosphere via the first and second mesh portions. As such, a fluid, for example, air, may flow into and out of the interior volume 14 and/or the filler material 30.

In the embodiments above, by positioning the first and second mesh portions 24, 26 over the first and second sides 16, 18 and the perimeter 20, a cross-flow of a fluid, such as air, may be accommodated through the interior volume 14 and/or filler material 30. For example, a fluid, such as air, may flow through a thickness of the pillow 10 between the first side 16 and the second side 18. In addition, the fluid, such as air, may flow in the length direction of the pillow 10 through opposing ends of the pillow 10 where the first and second mesh portions 24, 26 are positioned. By allowing the fluid, such as air, to flow in the cross-flow patterns described above, a cooling effect, or reduction of undesirable heat build-up within the pillow 10 may be provided.

Because sufficient airflow, and in particular, a cross-flow of air, between the interior volume 14 and the external atmosphere may be provided via the first and second mesh portions 24, 26, in some embodiments, the body portion 22 may be made from materials or constructed in a way to enhance certain characteristics, including cushioning, softness and stiffness, that may restrict breathability through the body portion 22. Accordingly, in the embodiments above, the cover layer 12 may be sufficiently breathable so as to limit or prevent increases in temperature that a user may consider uncomfortable.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A pillow comprising:

a cover layer defining an interior volume, the cover layer having a first side facing outward substantially in a first direction, a second side facing outward substantially in a second direction, opposite to the first direction, and a perimeter formed at a boundary of the first side and the second side, the cover layer comprising a body portion, a first mesh portion and a second mesh portion formed separately and spaced apart from the first mesh portion; and a filler material disposed in the interior volume, wherein the interior volume is in fluid communication with the external atmosphere via the first and second mesh portions, and wherein each mesh portion extends across a respective portion of the first side, the second side and the perimeter.

2. The pillow of claim 1, wherein the first and second mesh portion are positioned at opposite ends of the cover layer.

3. A pillow comprising:

a cover layer defining an interior volume, the cover layer having a first side facing outward substantially in a first direction, a second side facing outward substantially in a second direction, opposite to the first direction, and a perimeter formed at a boundary of the first side and the second side, the cover layer comprising a body portion, a first mesh portion and a second mesh portion formed separately and spaced apart from the first mesh portion; and a filler material disposed in the interior volume, wherein the interior volume is in fluid communication with the external atmosphere via the first and second mesh portions, and wherein each mesh portion is formed in a shape of a triangle on the first side.

4. The pillow of claim 3, wherein each mesh portion is formed in a shape of a triangle on the second side.

5. The pillow of claim 1, wherein the body portion is made from a knitted fabric, sateen weave or flat weave fabric.

6. The pillow of claim 1, wherein the filler material is polyester.

7. A pillow cover comprising:

a cover layer defining an interior volume, the cover layer having a first side facing outward substantially in a first direction, a second side facing outward substantially in a second direction, opposite to the first direction, and a perimeter formed at a boundary of the first side and the second side, the cover layer comprising a body portion, a first mesh portion and a second mesh portion formed separately and spaced apart from the first mesh portion; and wherein the interior volume is in fluid communication with the external atmosphere via the first and second mesh portions, and wherein each mesh portion extends across a respective portion of the first side, the second side and the perimeter.

8. The pillow cover of claim 7, wherein the first and second mesh portion are positioned at opposite ends of the cover layer.

9. A pillow cover comprising:

a cover layer defining an interior volume, the cover layer having a first side facing outward substantially in a first direction, a second side facing outward substantially in a second direction, opposite to the first direction, and a perimeter formed at a boundary of the first side and the second side, the cover layer comprising a body portion, a first mesh portion and a second mesh portion formed separately and spaced apart from the first mesh portion; and wherein the interior volume is in fluid communication with the external atmosphere via the first and second mesh portions, and wherein each mesh portion is formed in a shape of a triangle on the first side.

10. The pillow cover of claim 9, wherein each mesh portion is formed in a shape of a triangle on the second side.

11. The pillow cover of claim 7, wherein the body portion is made from a knitted fabric, sateen weave or flat weave fabric.

12. The pillow cover of claim 7, wherein the body portion comprises a first panel and a second panel.

13. The pillow cover of claim 12, wherein the first panel is connected to the second panel at the first side and the second side.

* * * * *